US005617887A

United States Patent [19]

Shibano

[11] Patent Number: 5,617,887

[45] Date of Patent: Apr. 8, 1997

[54] ULTRASONIC CLEANING APPARATUS

[76] Inventor: Yoshihide Shibano, 1629-1-12, Oyama-cho, Machida-shi, Tokyo, Japan

[21] Appl. No.: 495,109

[22] Filed: Jun. 27, 1995

[30] Foreign Application Priority Data

Jun. 27, 1994 [JP] Japan ..... 6-144311

[51] Int. Cl.[6] ..... B08B 3/12

[52] U.S. Cl. ..... 134/184; 134/1; 134/122 R

[58] Field of Search ..... 134/1, 184, 186, 134/122 R, 64 R; 68/355; 210/748; 148/DIG. 17; 310/311

[56] References Cited

U.S. PATENT DOCUMENTS

| | | | |
|---|---|---|---|
| 1,910,277 | 5/1933 | Bezzenberger | 134/1 |
| 2,259,260 | 10/1941 | Matteson et al. | 134/1 |
| 2,484,014 | 10/1949 | Peterson et al. | 134/1 |
| 3,572,352 | 3/1971 | Koopman | 134/1 |
| 3,712,833 | 1/1973 | Fichaux | 134/1 |
| 4,710,233 | 12/1987 | Hohmann et al. | 134/1 |
| 4,836,684 | 6/1989 | Javorik et al. | 134/184 |
| 5,133,376 | 7/1992 | Gamarin et al. | 134/184 |
| 5,183,512 | 2/1993 | Bragger . | |
| 5,409,594 | 4/1995 | Al-Jiboory et al. | 134/1 |

FOREIGN PATENT DOCUMENTS

| | | | |
|---|---|---|---|
| 46-11307 | 3/1971 | Japan | 134/1 |
| 52-3272 | 1/1977 | Japan | 134/1 |
| 53-9067 | 1/1978 | Japan | 134/1 |
| 58-57540 | 12/1983 | Japan | 134/1 |
| 4-341589 | 11/1992 | Japan | 134/1 |
| 633617 | 11/1978 | U.S.S.R. | 134/1 |
| 638637 | 12/1978 | U.S.S.R. | 134/1 |

*Primary Examiner*—Frankie L. Stinson
*Attorney, Agent, or Firm*—Paul A. Guss

[57] ABSTRACT

An ultrasonic cleaning apparatus has an ultrasonic vibrator mounted in a cleaning tank on a bottom thereof for radiating ultrasonic energy, and a deaerated cleaning solution stored in the cleaning tank and having a surface level at a position substantially corresponding to an integral multiple of half the wavelength of the ultrasonic energy radiated by the ultrasonic vibrator. A web-shaped or filamentary elongate metal workpiece, which is shaped to pass the ultrasonic energy easily therethrough, is horizontally moved in the cleaning solution at a position spaced from the surface level by a distance substantially equal to a quarter of the wavelength of the ultrasonic energy radiated by the ultrasonic vibrator. An electrode, which is shaped to pass the ultrasonic energy easily therethrough, is disposed in the cleaning solution and extending parallel to the workpiece. A voltage is applied between the electrode and the workpiece while the workpiece is being moved in the cleaning solution.

7 Claims, 2 Drawing Sheets

ULTRASONIC CLEANING APPARATUS

BACKGROUND OF THE INVENTION

1. Field of the Invention

The present invention relates to an ultrasonic cleaning apparatus, and more particularly to an ultrasonic cleaning apparatus suitable for cleaning a thick web-shaped metal workpiece or a thin filamentary elongate metal workpiece which suffers difficulties producing ultrasonic reflections.

2. Description of the Related Art

One known ultrasonic cleaning apparatus of the type described above has a supply reel with a wound web-shaped or filamentary metal workpiece, a take-up reel for winding the web-shaped or filamentary metal workpiece from the supply reel, and an ultrasonic vibrator for radiating ultrasonic energy toward the workpiece as it is transferred from the supply reel to the take-up reel while being immersed in a cleaning solution stored in a cleaning tank. The workpiece is passed through a position in the cleaning tank where intensive cavitation is developed by the radiated ultrasonic energy, for thereby maximizing the cleaning effect.

The workpiece may be cleaned within a relatively short period of time for increased cleaning efficiency when the workpiece is moved at an increased speed through the cleaning solution. When the workpiece is moved at the increased speed, however, the workpiece passes quickly through the position where intensive cavitation is developed. Therefore, the workpiece may not be sufficiently cleaned because it is not fully exposed to the cleaning effect produced by cavitation.

SUMMARY OF THE INVENTION

It is therefore an object of the present invention to provide an improved ultrasonic cleaning apparatus.

Another object of the present invention is to provide an ultrasonic cleaning apparatus which is capable of ultrasonically cleaning a web-shaped or filamentary metal workpiece with increased cleaning efficiency and with a high cleaning effect.

Direct ultrasonic energy radiated from an ultrasonic vibrator into a cleaning solution is reflected by the surface level of the cleaning solution. If the surface level of the cleaning solution is spaced from the ultrasonic vibrator by a distance that is substantially equal to an integral multiple of half the wavelength of the ultrasonic energy, then a standing wave is produced by the ultrasonic energy reflected from the surface level and the direct ultrasonic energy radiated from the ultrasonic vibrator, and a first antinode of the standing wave is formed in a position spaced downwardly from the surface level of the cleaning solution by a distance which is substantially equal to a quarter of the wavelength of the ultrasonic energy. In this position, cavitation is easily developed because the sound pressure of the ultrasonic energy varies to a greatest degree.

If a workpiece is shaped to pass ultrasonic energy easily therethrough, then even when the workpiece is positioned between the surface level of the cleaning solution and the ultrasonic vibrator, any reflection or attenuation by the workpiece of the ultrasonic energy radiated from the ultrasonic vibrator is reduced. A standing wave which is the same as the standing wave described above is developed, allowing cavitation to be easily developed at a position spaced downwardly from the surface level of the cleaning solution by a distance which is substantially equal to a quarter of the wavelength of the ultrasonic energy.

When the workpiece is moved horizontally at the position spaced downwardly from the surface level of the cleaning solution by a distance which is substantially equal to a quarter of the wavelength of the ultrasonic energy, the developed cavitation is concentrated on the workpiece, thereby ultrasonically cleaning the workpiece with an increased cleaning effect. However, when the speed at which the workpiece is moved is increased, then no sufficient cleaning effect may be obtained.

The inventor has found, as a result of various research efforts to solve the above problem, that the workpiece is exposed to more cavitation for increased cleaning efficiency by placing an electrode in the cleaning solution parallel to the workpiece and applying a voltage between the electrode and the workpiece, and has achieved the present invention based on that finding.

To accomplish the above object, there is provided in accordance with the present invention an ultrasonic cleaning apparatus comprising a cleaning tank, an ultrasonic vibrator mounted in the cleaning tank on a bottom thereof for radiating ultrasonic energy, a deaerated cleaning solution stored in the cleaning tank and having a surface level at a position substantially corresponding to an integral multiple of half the wavelength of the ultrasonic energy radiated by the ultrasonic vibrator, workpiece moving means for horizontally moving a web-shaped or filamentary elongate metal workpiece, which is shaped to pass the ultrasonic energy easily therethrough, in the cleaning solution at a position spaced from the surface level by a distance substantially equal to a quarter of the wavelength of the ultrasonic energy radiated by the ultrasonic vibrator, an electrode disposed in the cleaning solution and extending parallel to the workpiece, the electrode being shaped to pass the ultrasonic energy easily therethrough, and voltage applying means for applying a voltage between the electrode and the workpiece while the workpiece is being horizontally moved in the cleaning solution by the workpiece moving means.

With the above arrangement, since the electrode is shaped to pass the ultrasonic energy easily therethrough, any reflection or attenuation by the electrode and the workpiece of the ultrasonic energy radiated from the ultrasonic vibrator is reduced. Therefore, a standing wave which is the same as the standing wave described above is developed, allowing cavitation to be easily developed at a position spaced downwardly from the surface level of the cleaning solution by a distance which is substantially equal to a quarter of the wavelength of the ultrasonic energy. The workpiece that passes through the above position is exposed to the cavitation, and can be cleaned with an increased cleaning effect.

When a voltage is applied between the workpiece and the electrode, an electric field is developed between the electrode and the workpiece to concentrate the cavitation on the workpiece. Since the cavitation is concentrated on the workpiece which passes through a region where the cavitation tends to be easily generated by the standing wave, the workpiece is reliably cleaned even if the workpiece passes through the cleaning solution at a relatively high speed, and hence the period of time required to clean the workpiece is shortened.

The electrode may be filamentary or web-shaped as with the workpiece to eliminate unnecessary regions in the generation of an electric field between the electrode and the workpiece. Consequently, the electric field can be generated highly efficiently, reliably concentrating the cavitation on the workpiece while it is in motion.

The filamentary or web-shaped electrode allows the ultrasonic energy to pass easily therethrough, and prevents the ultrasonic energy produced by the ultrasonic vibrator from being unduly attenuated. However, the web-shaped electrode may possibly tend to somewhat attenuate the ultrasonic energy because it has a certain width. If the electrode were positioned between the workpiece and the ultrasonic vibrator, then the electrode would possibly attenuate the direct ultrasonic energy radiated from the ultrasonic vibrator, making it impossible to produce a strong standing wave. According to the present invention, the effect which the electrode has on the direct ultrasonic energy radiated from the ultrasonic vibrator is reduced by positioning the electrode between the workpiece in the cleaning solution and the surface level of the cleaning solution.

Furthermore, the cleaning tank has a pair of opposite spaced side walls having respective aligned through holes defined therein for passage of the workpiece therethrough when the workpiece is horizontally moved, the through holes being disposed at a position spaced from the surface level by a distance substantially equal to a quarter of the wavelength of the ultrasonic energy radiated by the ultrasonic vibrator, and the ultrasonic cleaning apparatus further comprises a pair of reservoirs disposed outwardly of the side walls, respectively, for storing the cleaning solution which leaks out of the cleaning tank through the through holes, and cleaning solution circulating means for returning the cleaning solution stored in the reservoirs back to the cleaning tank to keep the surface level of the cleaning solution constant in the cleaning tank.

The workpiece may be guided downwardly into the cleaning tank from a position above the cleaning tank, then moved horizontally a certain interval at a position spaced downwardly from the surface level of the cleaning solution by a distance which is substantially equal to a quarter of the wavelength of the ultrasonic energy, and thereafter guided upwardly to a position above the cleaning tank. According to the present invention, however, the workpiece is moved horizontally in the cleaning solution in the cleaning tank through the through holes defined in the side walls of the cleaning tank. Therefore, the workpiece can be moved horizontally in the cleaning solution in the cleaning tank through the entire width of the cleaning tank, and hence the entire width of the cleaning tank is available for ultrasonically cleaning the workpiece in the cleaning solution. Any cleaning solution that leaks out of the cleaning tank through the through holes is stored in the reservoirs, and then returned back to the cleaning tank by the cleaning solution circulating means. As a consequence, the surface level of the cleaning solution is maintained constant in the cleaning tank, allowing the workpiece to be cleaned reliably at the position where most cavitation is developed in the cleaning solution.

The ultrasonic cleaning apparatus also has insulating coverings fitted respectively in inner circumferential edges of the through holes. The insulating coverings prevent the workpiece and the cleaning tank from being held in electric contact with each other when a voltage is applied between the electrode and the workpiece, so that a proper electric field is generated between the workpiece and the electrode.

For easier passage of the ultrasonic energy therethrough, the electrode may be made of a material selected from stainless steel, a titanium-base metal, a tantalum-base metal, and a base of glass coated with an evaporated layer of metal. If electrode is made of stainless steel, then it should preferably have a thickness ranging from 0.1 to 3.0 mm. If the thickness of the electrode were smaller than 0.1 mm, then the electrode would have no sufficient mechanical strength. If the thickness of the electrode were in excess of 3.0 mm, then the ability of the electrode to pass the ultrasonic energy therethrough would be low.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
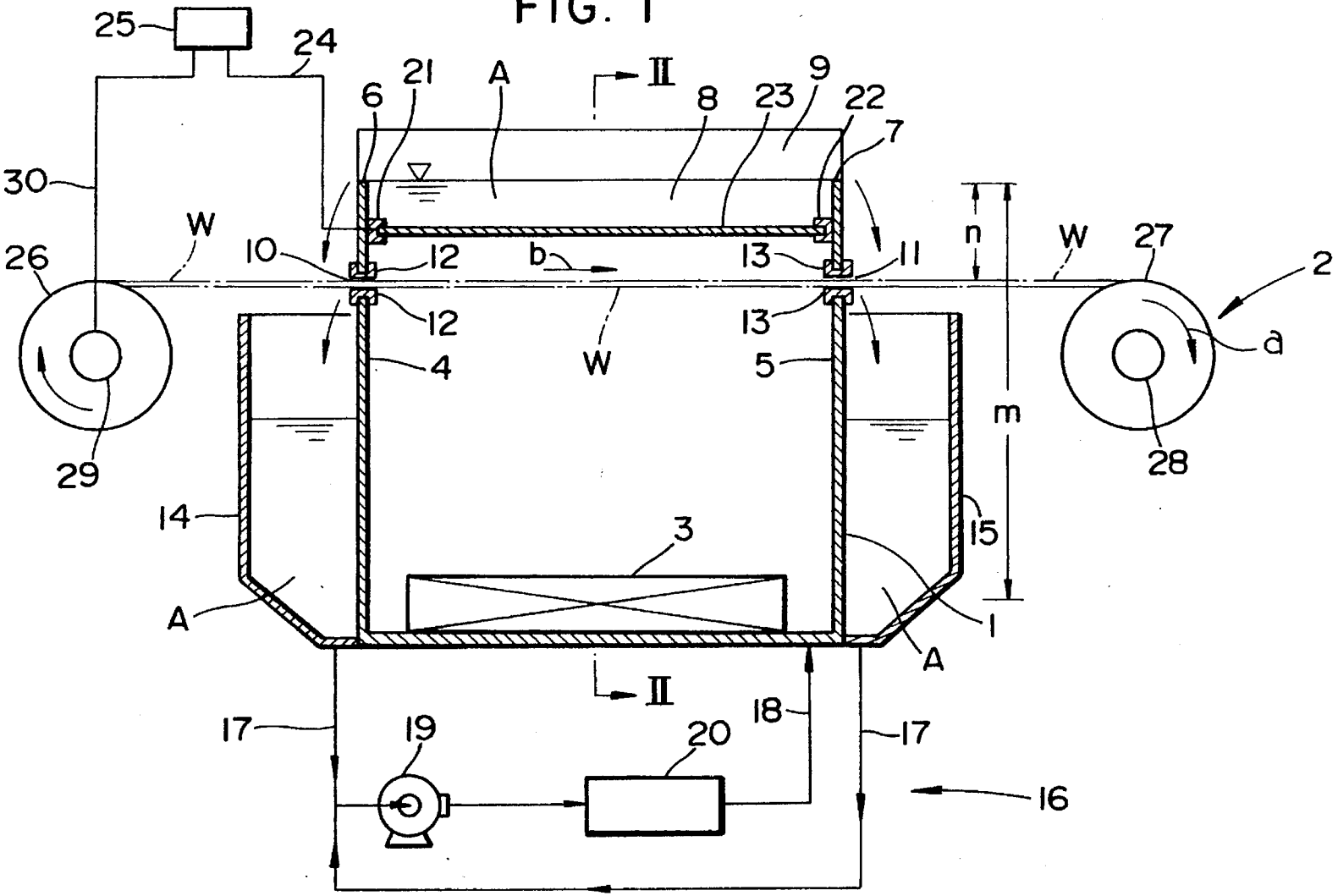
FIG. 1 is a vertical cross-sectional view of an ultrasonic cleaning apparatus according to an embodiment of the present invention.

As shown in FIG. 1, an ultrasonic cleaning apparatus according to an embodiment of the present invention has a cleaning tank 1 which stores a cleaning solution A therein and a workpiece moving means 2 for moving a workpiece W horizontally in the cleaning tank 1. A pair of reservoirs 14, 15 is attached to the cleaning tank 1 for storing the cleaning solution A which is discharged from the cleaning tank 1. An electrode 23 which extends horizontally in the cleaning tank 1 is positioned between the workpiece W in the cleaning solution A and the surface level of the cleaning solution A. The workpiece W is made of a metal which is an electric conductor and has a web shape having a width of about 50 mm and a thickness of about 0.5 mm, and generally known as a hoop. The ultrasonic cleaning apparatus according to this embodiment is suitable for ultrasonically cleaning hoops whose width ranges from 5 to 800 mm and thickness from 0.02 to 6 mm.

As shown in FIG. 1, the cleaning tank 1 is in the form of an upwardly open box and contains deaerated tap water as the cleaning solution A. However, the cleaning solution A is not limited to tap water, but may be an aqueous solution of detergent or the like. An ultrasonic vibrator 3 for radiating ultrasonic energy into the cleaning solution A is mounted on the inner surface of the bottom of the cleaning tank 1. The ultrasonic vibrator 3 is energized by an ultrasonic oscillator (not shown) to radiate ultrasonic energy at a predetermined frequency. In this embodiment, the ultrasonic vibrator 3 radiates ultrasonic energy at a frequency of 25 kHz.

Figure 2:
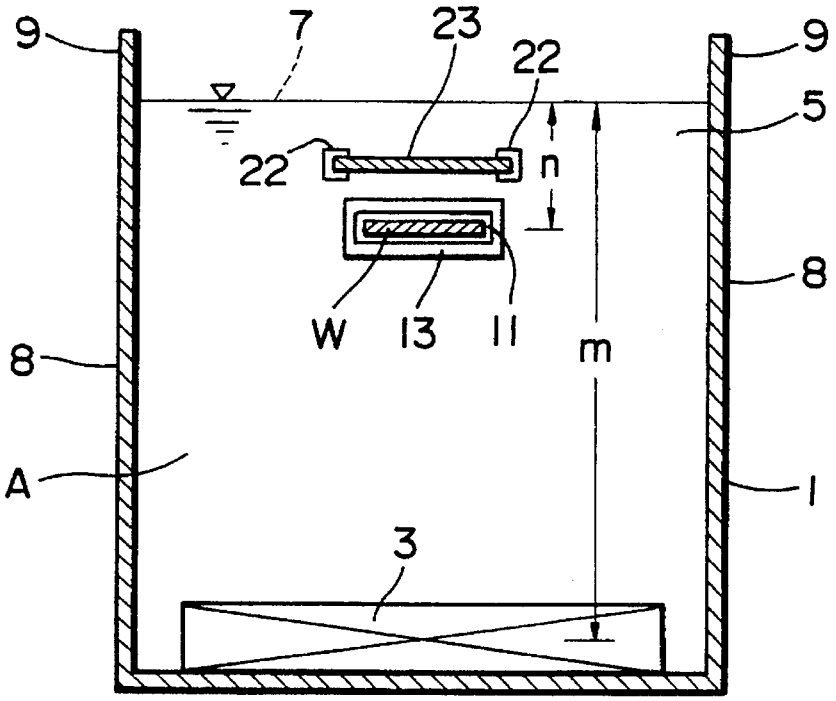
FIG. 2 is a cross-sectional view taken along line II—II of FIG. 1.

The cleaning tank 1 has a pair of laterally spaced, opposite side walls 4, 5 partly covered with the respective reservoirs 14, 15 and having respective upper edges 6, 7 at positions substantially corresponding to an integral multiple of half the wavelength of the ultrasonic energy radiated by the ultrasonic vibrator 3. As shown in FIGS. 1 and 2, the cleaning tank 1 also has other side walls 8 having respective upper edges 9 projecting upwardly beyond the upper edges 6, 7 of the side walls 4, 5. Therefore, even when the cleaning solution A overflows the upper edges 6, 7 of the side walls 4, 5, it is prevented from overflowing the upper edges 9 of the side walls 8. The surface level of the cleaning solution A stored in the cleaning tank 1 is aligned with the upper edges 6, 7 of the side walls 4, 5 for thereby substantially equalizing the distance "m" from the ultrasonic vibrator 3 to the surface level of the cleaning solution A to an integral multiple of half the wavelength of the ultrasonic energy radiated by the ultrasonic vibrator 3. When the surface level of the cleaning solution A exceeds the upper edges 6, 7 of the side walls 4, 5, the cleaning solution A flows over the upper edges 6, 7 out of the cleaning tank 1, thus keeping the surface level of the cleaning solution A constant in the cleaning tank 1.

The side walls 4, 5 have respective through holes 10, 11 defined therein in alignment with each other at a position spaced downwardly from their upper edges 6, 7 by a distance "n" which is substantially equal to a quarter of the wavelength of the ultrasonic energy radiated from the ultrasonic vibrator 3. The workpiece W passes horizontally in the cleaning tank 1 through the through holes 10, 11, which have a cross-sectional shape complementary to the cross-sectional shape of the workpiece W. Therefore, the workpiece W is horizontally movable in the cleaning tank 1 at the position spaced downwardly from the upper edges 6, 7 of the side walls 4, 5 by a distance "n" which is substantially equal to a quarter of the wavelength of the ultrasonic energy radiated from the ultrasonic vibrator 3.

The ultrasonic energy radiated from the ultrasonic vibrator 3 into the cleaning solution A is reflected by the surface level of the cleaning solution A which substantially corresponds to an integral multiple of half the wavelength of the ultrasonic energy radiated by the ultrasonic vibrator 3, producing a standing wave at the position spaced downwardly from the surface level by a distance "n" which is substantially equal to a quarter of the wavelength of the ultrasonic energy radiated from the ultrasonic vibrator 3. Since the electrode 23 immersed in the cleaning solution A in the cleaning tank 1 is of a shape capable of easily passing the ultrasonic energy therethrough, any attenuation of the ultrasonic energy by the electrode 23 is very small, allowing a standing wave to be produced reliably at the position where the workpiece W passes through the cleaning solution A, so that a high cleaning effect can be developed by cavitation. In this embodiment, the distance "n" that is substantially equal to a quarter of the wavelength of the ultrasonic energy is about 15 mm because the frequency of the ultrasonic energy is 25 kHz.

The cleaning tank 1 is made of an electric conductor such as metal or the like. Therefore, insulating coverings 12, 13 are fitted over the inner circumferential edges of the through holes 10, 11 for electrically insulating the workpiece W from the cleaning tank W. When a voltage is applied to the workpiece W as described later on, therefore, no electric contact is established between the workpiece W and the cleaning tank 1.

As shown in FIG. 1, the reservoirs 14, 15 for storing the cleaning solution A which is discharged from the cleaning tank 1 over the upper edges 6, 7 and leaks out of the through holes 10, 11 is positioned outwardly of the side walls 4, 5. The reservoirs 14, 15 are combined with a cleaning solution circulating means 16 for returning the cleaning solution A stored in the reservoirs 14, 15 back to the cleaning tank 1. The cleaning solution circulating means 16 comprises a circulating pump 19 for drawing the cleaning solution A from the reservoirs 14, 15 through outlet conduits 17 and introducing the cleaning solution A into the cleaning tank 1 through an inlet conduit 18, and a deaerator 20 for deaerating the cleaning solution A while it is passing through the inlet conduit 18. Because the through holes 10, 11 are positioned below the surface level of the cleaning solution A in the cleaning tank 1, the cleaning solution A tends to leak out of the cleaning tank 1 through the through holes 10, 11. However, the cleaning solution A that has leaked is returned from the reservoirs 14, 15 back to the cleaning tank 1 by the circulating pump 19, thereby preventing the surface level of the cleaning solution A from dropping in the cleaning tank 1. If more cleaning solution A is returned from the reservoirs 14, 15 to the cleaning tank 1 by the circulating pump 19 than it leaks through the through holes 10, 11, then any excessive cleaning solution A overflows the upper edges 6, 7 of the side walls 4, 5, thereby preventing the surface level of the cleaning solution A from increasing in the cleaning tank 1. Inasmuch as the surface level of the cleaning solution A is kept constant in the cleaning tank 1, the surface level of the cleaning solution A is maintained at a position that is an integral multiple of half the wavelength of the ultrasonic energy radiated from the ultrasonic vibrator 3. Consequently, the ultrasonic energy radiated from the ultrasonic vibrator 3 into the cleaning solution A is reflected at a constant position at all times. Therefore, a standing wave is generated stably at the position where the workpiece W passes through the cleaning tank 1, and hence intensive cavitation is developed in the position where the workpiece W passes.

As shown in FIGS. 1 and 2, the electrode 23, made of stainless steel, is supported horizontally on the side walls 4, 5 by insulating supports 21, 22 vertically between the upper edges 6, 7 thereof and the through holes 10, 11, and extends parallel to the workpiece W. The electrode 23 comprises an elongate plate substantially identical in shape to the workpiece W, and has a thickness of 1.5 mm. The material of the electrode 23 is not limited to stainless steel, but may be a titanium-base metal, a tantalum-base metal, or a base of glass coated with an evaporated layer of metal. A voltage applying means 25 (described later on) is electrically connected to one end of the electrode 23 through a lead 24. The thickness of the electrode 23, which is selected to be 1.5 mm for allowing ultrasonic energy to pass easily therethrough in, this embodiment, is determined depending on the frequency of the ultrasonic energy, the temperature of the cleaning solution A, and the material of the electrode 23.

If the frequency of the ultrasonic energy is 25 kHz, the temperature of the cleaning solution A is about 20° C., and the material of the electrode 23 is stainless steel, then the thickness of the electrode 23 is about 1.5 mm for allowing sufficient ultrasonic energy to pass therethrough because if the thickness of the electrode 23 exceeded 1.5 mm, the transmittance of the ultrasonic energy through the electrode 23 would be lower than 50%, and if the thickness of the electrode 23 were smaller than 1.5 mm, the transmittance of the ultrasonic energy through the electrode 23 would be higher than 50%.

Under the above conditions, the transmittance of the ultrasonic energy through the electrode 23 is 70% when the thickness of the electrode 23 is 1.2 mm, 80% when the thickness of the electrode 23 is 1 mm, and 90% when the thickness of the electrode 23 is 0.7 mm. Therefore, the electrode 23 should preferably be as much thin as possible provided its mechanical strength is sufficient. Since the electrode 23 is of a shape which allows ultrasonic energy to pass easily therethrough, it does not substantially reflect or attenuate the ultrasonic energy radiated from the ultrasonic vibrator 3. The ultrasonic energy radiated from the ultrasonic vibrator 3 is not affected by the electrode 23 in the cleaning solution A, but is reflected by the surface level of the cleaning solution A, and then develops intensive cavitation accurately at the position corresponding to a quarter of the wavelength of the ultrasonic energy below the surface level. Because the electrode 23 is disposed between the workpiece W in the cleaning solution A in the cleaning tank 1 and the surface level of the cleaning solution A, any attenuation of the direct ultrasonic energy radiated from the ultrasonic vibrator 3 is much smaller than would be if the electrode 23 were positioned between the workpiece W and the ultrasonic vibrator 3.

As shown in FIG. 1, the workpiece moving means 2 comprises a supply reel 26 rotatably disposed out of the cleaning tank 1 at its left and a take-up reel 27 rotatably disposed out of the cleaning tank 1 at its right, the take-up reel 27 being positioned opposite to the supply reel 26 across the cleaning tank 1. The workpiece W is coiled around the supply reel 26, and has its leading end extending through the through hole 10 in the left side wall 4 of the cleaning tank 1 and the through hole 11 in the right side wall 5 thereof, and wound on the take-up reel 27. As described above, the workpiece W is horizontally movable in the cleaning tank 1 through the through holes 10, 11 at the position that is spaced downwardly from the surface level of the cleaning solution A by the distance "n" which is substantially equal to a quarter of the wavelength of the ultrasonic energy radiated from the ultrasonic vibrator 3. The take-up reel 27 has a shaft 28 coupled to an actuator (not shown) for rotation thereby in the direction indicated by the arrow "a". When the take-up reel 27 is rotated by the actuator, the take-up reel 27 winds the workpiece W thereon and moves the workpiece W horizontally through the cleaning solution A in the direction indicated by the arrow "b".

The supply reel 26 has a shaft 29 to which the voltage applying means 25 is electrically connected through a lead 30. The workpiece W coiled around the supply reel 26 is electrically connected to the lead 30 through the shaft 29. The voltage applying means 25 applies a voltage between the electrode 23 and the workpiece W through the leads 24, 30. The distance by which the electrode 23 is spaced from the workpiece W is determined depending on the voltage to be applied between the electrode 23 and the workpiece W, the type of the cleaning solution A (particularly, the conductivity thereof), etc. In this embodiment, the distance between the electrode 23 and the workpiece W is 15 mm under the conditions that the voltage applied between the electrode 23 and the workpiece W is about DC 3 V and the cleaning solution A is tap water.

When the voltage is applied between the workpiece W and the electrode 23 thus arranged, the workpiece W is exposed to intensive cavitation. Since the electrode 23 is positioned without disturbing the intensive cavitation in the cleaning solution A at the position spaced a quarter of the wavelength of the ultrasonic energy from the surface level of the cleaning solution A and also since the electrode 23 is substantially identical in shape to the workpiece W, the electrode 23 can generate an electric field highly efficiently, concentrating the cavitation efficiently on the workpiece W. Inasmuch as the cleaning effect on the workpiece W is very high, the workpiece W can reliably be cleaned even when the take-up reel 27 is rotated quickly to wind the workpiece W and hence move the workpiece W in the cleaning solution A at an increased speed. Therefore, the period of time that is required to clean the workpiece W ultrasonically is shortened, permitting the workpiece W to be cleaned highly efficiently.

Figure 3:
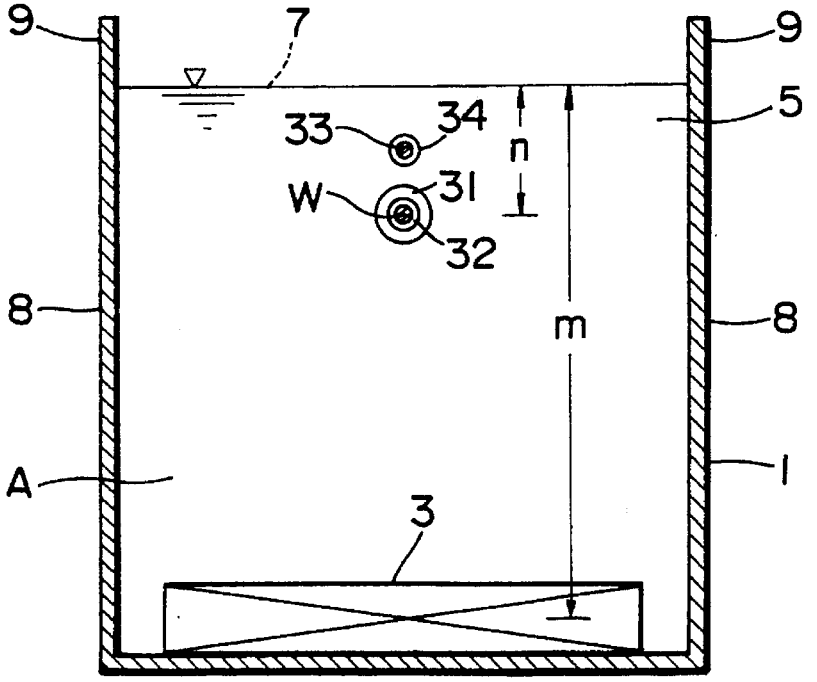
FIG. 3 a vertical cross-sectional view of an ultrasonic cleaning apparatus according to another embodiment of the present invention.

In the illustrated embodiment, the workpiece W is web-shaped. However, the workpiece W may be a filamentary shape such as a wire shape as shown in FIG. 3. The ultrasonic cleaning apparatus according to the present invention is effective to ultrasonically clean a filamentary workpiece W having a diameter in the range of from 20μto 8 mm.

More specifically, as shown in FIG. 3, a cleaning tank 1 has circular through holes 32 defined respectively in opposite side walls 4, 5 (see FIG. 1) for insertion therethrough of the workpiece W and fitted with insulating coverings 31 on their respective inner circumferential edges. A filamentary electrode 33 which is substantially identical in shape to the workpiece W is supported horizontally on the side walls 4, 5 by insulating supports 34 and extends between the side walls 4, 5 parallel to the workpiece W. The other details of the ultrasonic cleaning apparatus shown in FIG. 3 are identical to those of the ultrasonic cleaning apparatus shown in FIGS. 1 and 2, and denoted by identical reference numerals and will not be described in detail below.

When the filamentary workpiece W passes through the cleaning solution A in the cleaning tank 1 at a position spaced downwardly from the surface level of the cleaning solution A by a distance "n" that is substantially equal to a quarter of the wavelength of the ultrasonic energy radiated from the ultrasonic vibrator 3, the filamentary workpiece W is efficiently cleaned by cavitation developed in the cleaning solution A. When a voltage is applied between the electrode 33 and the workpiece W, the workpiece W is subjected to intensive cavitation for higher cleaning efficiency.

INVENTIVE EXAMPLE

An experiment was conducted on the ultrasonic cleaning apparatus shown in FIGS. 1 and 2 for ultrasonically cleaning a web-shaped hoop having a width of about 50 mm and a thickness of about 0.5 mm.

In the experiment, deaerated tap water was used as the cleaning solution A, and the hoop, 500 m long, was coiled around the supply reel 26 and its leading end was passed through the through holes 10, 11 and wound on the take-up reel 27. The hoop was wound around the take-up reel 27 at a rate of 10 m/minute while being moved horizontally through the cleaning solution A in the direction indicated by the arrow "b". At the same time, ultrasonic energy was radiated at a frequency of 25 kHz from the ultrasonic vibrator 3 into the cleaning solution A, thus ultrasonically cleaning the workpiece W. The electrode 23 and the hoop were spaced from each other by 15 mm, and a voltage of about DC 3 V was applied between the electrode 23 as a negative electrode and the hoop as a positive electrode.

As a result, it took 50 minutes to ultrasonically clean the hoop to the level of cleaned quality sufficient in Use.

COMPARATIVE EXAMPLE

Except that the electrode 23 was removed from the cleaning tank 1 and no voltage was applied between the electrode 23 and the hoop, the hoop was ultrasonically cleaned under the same conditions as with the Inventive Example above. In order to achieve the same level of cleaned quality of the hoop in the Inventive Example above, the hoop had to be wound by the take-up reel at a lower rate of 1.0 m/minute, and it took 500 minutes, much longer than with the Inventive Example above to ultrasonically clean the hoop.

It can be seen from the Inventive and Comparative Examples given above that the ultrasonic cleaning apparatus according to the present invention can ultrasonically clean a workpiece with increased cleaning efficiency and with a high cleaning effect.

Although certain preferred embodiments of the present invention have been shown and described in detail, it should be understood that various changes and modifications may be made therein without departing from the scope of the appended claims.

What is claimed is:

1. An ultrasonic cleaning apparatus comprising:

a cleaning tank;

an ultrasonic vibrator mounted in said cleaning tank on a bottom thereof for radiating ultrasonic energy;

a deaerated cleaning solution stored in said cleaning tank and having a surface level at a position substantially corresponding to an integral multiple of half the wavelength of the ultrasonic energy radiated by the ultrasonic vibrator;

workpiece moving means for horizontally moving a web-shaped or filamentary elongate metal workpiece, which is shaped to pass the ultrasonic energy easily therethrough, in the cleaning solution at a position spaced from said surface level by a distance substantially equal to a quarter of the wavelength of the ultrasonic energy radiated by the ultrasonic vibrator;

an electrode disposed in said cleaning solution and extending parallel to said workpiece, said electrode being shaped to pass the ultrasonic energy easily therethrough; and voltage applying means for applying a voltage between said electrode and said workpiece while the workpiece is being horizontally moved in the cleaning solution by said workpiece moving means.

2. An ultrasonic cleaning apparatus according to claim 1, wherein said electrode is web-shaped or filamentary.

3. An ultrasonic cleaning apparatus according to claim 2, wherein said electrode is web-shaped, and is disposed between said workpiece in the cleaning solution and the surface level thereof.

4. An ultrasonic cleaning apparatus according to claim 1, wherein said cleaning tank has a pair of opposite spaced side walls having respective aligned through holes defined therein for passage of said workpiece therethrough when the workpiece is horizontally moved, said through holes being disposed at a position spaced from said surface level by a distance substantially equal to a quarter of the wavelength of the ultrasonic energy radiated by the ultrasonic vibrator, further comprising a pair of reservoirs disposed outwardly of said side walls, respectively, for storing the cleaning solution which leaks out of said cleaning tank through said through holes, and cleaning solution circulating means for returning the cleaning solution stored in said reservoirs back to said cleaning tank to keep the surface level of the cleaning solution constant in said cleaning tank.

5. An ultrasonic cleaning apparatus according to claim 4, further comprising insulating coverings fitted respectively in inner circumferential edges of said through holes.

6. An ultrasonic cleaning apparatus according to claim 1, wherein said electrode is made of a material selected from the group consisting of stainless steel, a titanium-base metal, a tantalum-base metal, and a base of glass coated with an evaporated layer of metal.

7. An ultrasonic cleaning apparatus according to claim 6, wherein said electrode is made of stainless steel, and has a thickness ranging from 0.1 to 3.0 mm.

* * * * *